US007398890B2

(12) United States Patent
Thomson

(10) Patent No.: US 7,398,890 B2
(45) Date of Patent: Jul. 15, 2008

(54) LIQUID CONTAINER CLOSURE ASSEMBLY

(75) Inventor: David William Thomson, Glasgow (GB)

(73) Assignee: Guala Closures Patents B.V., Amsterdam (NL)

( * ) Notice: Subject to any disclaimer, the term of this patent is extended or adjusted under 35 U.S.C. 154(b) by 451 days.

(21) Appl. No.: 11/005,198

(22) Filed: Dec. 6, 2004

(65) Prior Publication Data

US 2005/0115915 A1 Jun. 2, 2005

Related U.S. Application Data

(63) Continuation of application No. PCT/GB03/02185, filed on May 21, 2003.

(30) Foreign Application Priority Data

Jun. 10, 2002 (GB) ..... 0213257.9

(51) Int. Cl.
*B65D 55/08* (2006.01)
*B65D 41/04* (2006.01)
*B65D 49/04* (2006.01)

(52) U.S. Cl. ..... 215/252; 215/277; 215/258; 215/21

(58) Field of Classification Search ..... 215/14, 215/17, 18, 21, 277, 252, 258
See application file for complete search history.

(56) References Cited

U.S. PATENT DOCUMENTS 2,970,711 A 2/1961 Goldstein
3,850,328 A * 11/1974 Guala ..... 215/252
4,382,520 A * 5/1983 Aleff ..... 215/21
4,458,817 A * 7/1984 Guala ..... 215/21
4,497,415 A * 2/1985 Arona Delonghi ..... 215/21
4,550,845 A * 11/1985 Guala ..... 215/252
5,251,769 A * 10/1993 Battegazzore ..... 215/252
5,419,446 A * 5/1995 Cox et al. ..... 215/21
5,484,084 A * 1/1996 Junqueras Guerre ..... 222/147
5,740,932 A * 4/1998 Battegazzore ..... 215/252
6,276,544 B1 8/2001 Battegazzore (Continued)

FOREIGN PATENT DOCUMENTS

EP 0988237 B1 2/2002

(Continued)

OTHER PUBLICATIONS

International Preliminary Examination Report in PCT/GB 03/02185.

*Primary Examiner*—Anthony D. Stashick
*Assistant Examiner*—James Smalley
(74) *Attorney, Agent, or Firm*—Notaro & Michalos P.C.

(57) ABSTRACT

A closure assembly for a mouth and neck portion of a container for liquid has a sleeve adapted to lie substantially concentrically with respect to the mouth and provided with a mechanism for fixing the sleeve on the container. A first outer sleeve is coaxially mounted over the sleeve and a second outer sleeve separate from the first outer sleeve and substantially tight fit with a container closure member. The first and second outer sleeves are axially aligned and have respective initially adjacent portions. A mechanism is provided for spacing apart the initially adjacent portions of the first and second outer sleeves upon reclosure of the assembly after an initial opening of the container.

18 Claims, 5 Drawing Sheets

U.S. PATENT DOCUMENTS

| | | | | |
|---|---|---|---|---|
| 6,619,492 | B2 * | 9/2003 | Battegazzore | 215/21 |
| 6,854,612 | B2 * | 2/2005 | Thomson | 215/21 |

FOREIGN PATENT DOCUMENTS

| | | | |
|---|---|---|---|
| FR | 2340256 | | 9/1977 |
| GB | 2158424 | A | 11/1985 |
| GB | 2 366 287 | A | 3/2002 |
| WO | WO 00/07898 | | 2/2000 |
| WO | WO 00/75033 | A1 | 12/2000 |
| WO | WO 02/18224 | A1 | 3/2002 |
| WO | WO 02/083518 | A1 | 10/2002 |
| WO | WO 02/096771 | A1 | 12/2002 |

* cited by examiner

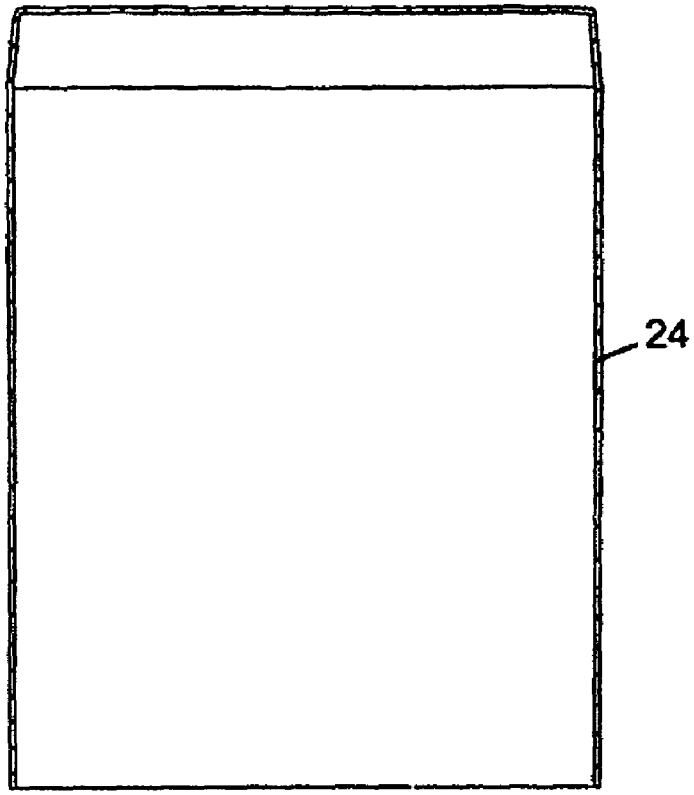
Fig. 1
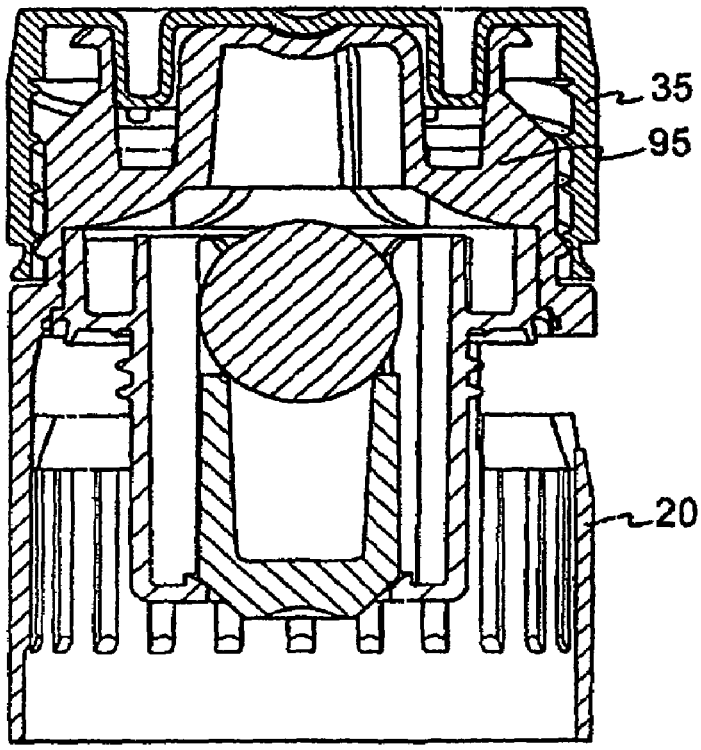

LIQUID CONTAINER CLOSURE ASSEMBLY

CROSS-REFERENCE TO RELATED APPLICATIONS

This application is a continuation application of International Application No. PCT/GB03/02185 filed May 21, 2003, and incorporated herein by reference, which claims priority based on British Application No. 0213257.9 filed Jun. 10, 2002, which claim in repeated here.

FIELD OF INVENTION

The present invention relates to a closure assembly adapted to be applied to a mouth of a container (e.g. for liquid), such as a neck of a bottle. The invention particularly, thought not exclusively, relates to a tamper-evident non-refillable snap-on fitment.

BACKGROUND TO INVENTION

For various reasons, it may be desirable to ensure that a used container, such as a bottle intended to contain a liquid such as a valuable liquid, (e.g. spirits such as alcoholic beverages), is not re-filled with a replacement quantity of another liquid, the characteristics and quality of which may differ from the original contents. Attempts to provide closures which make such re-filling difficult are not always proof against determined tampering. While it is considered advantageous to provide a tamper-indicating means which provides evidence that the bottle and its original contents are intact, if the bottle is resealable with a substitute cap or closure, there may be little to indicate to a purchaser that the bottle has been tampered with and that the contents may be inferior to the original contents.

It has, therefore, been found desirable to provide a closure which cannot be removed without an extreme level of effort, or breakage being caused to the bottle. Such an arrangement is shown, for example, in GB Patent No. 2 274 837 also by the present Applicant, selected merely by way of illustration.

Whilst it is very important that an original closure cannot be removed without visible damage or breakage being caused either to the closure and/or to the bottle, it has been found that a closure that cannot readily be removed will become the target of attempts to re-fill the container by overcoming the feature provided in the closure intended to hinder or prevent such refilling. Therefore, in addition to providing devices to prevent re-filling of bottles, there is a need to provide such devices with further tamper-indicating features which, while not acting in any preventive role, give a clear irremovable and/or irreversible indication that a bottle has been opened since being originally filled with the genuine contents. Such clear indicators have been somewhat lacking in previous closure designs.

Furthermore, there is a need for simple designs of closure assemblies allowing easy and reliable manufacture, assembly and fitting to bottle necks. Such simplicity has been somewhat lacking in previous closure. designs.

It is an object of at least one aspect of the present invention to provide an improved closure assembly which does not have any parts which are frangible and/or removed upon initial opening and which are liable to be reattached by counterfeiters or the like in a way suggesting that the closure assembly had not previously been opened.

It is also an object of a least one aspect of the present invention to obviate or at least mitigate at least one of the aforementioned problems/disadvantages in the prior art.

SUMMARY OF INVENTION

According to a first aspect of the present invention there is provided a closure assembly (or tamper-evident device) adapted to be applied to a mouth and neck portion of a container for liquid, the closure assembly comprising a sleeve adapted to lie substantially concentrically with respect to the mouth and provided with means for fixing the sleeve on the container, the closure assembly further comprising a first outer sleeve being a substantially tight fit with the sleeve but rotatable with respect thereto, and a second outer sleeve separate from the first outer sleeve and associated with a container closure member, and wherein there are provided means for spacing apart initially adjacent portions of the first and second outer sleeves upon reclosure of the assembly after an initial opening of the container.

The Applicant has named the device of the invention the "ALUSNAP" (Trade Mark) non-refillable closure assembly or tamper-evident device.

Most advantageously the first outer sleeve and second outer sleeve are separate one from the other prior to initial opening of the closure assembly.

Preferably the first outer sleeve has open first and second ends and the second outer sleeve has a first closed end and second open end.

Preferably the container closure member includes a circumferential groove, which may further provide a circumferential lip portion located below and adjacent to the circumferential groove.

The initially adjacent portions may comprise adjacent respective circumferential edges of the first and second outer sleeves.

The first and second circumferential edges may prior to initial opening be located in the circumferential groove and may be adjacent one another.

Preferably, during an initial container opening operation, the first circumferential edge expands or rides over the circumferential lip portion and then recoils or retracts preferably to substantially its original circumferential position so as to become positioned circumferentially behind the circumferential lip portion. Alternatively or additionally during an initial container opening operation, the circumferential lip portion contracts or rides under the first circumferential edge and then recoils or expands preferably to substantially its original circumferential position so as to become positioned circumferentially ahead of the first circumferential edge. This action positions the circumferential lip longitudinally between the first and second circumferential edges in an obstructive manner such that when the container is reclosed by re-applying the closure member, the first and second outer sleeves are spaced apart at least by the circumferential lip portion located therebetween.

By this arrangement after reclosure the first and second circumferential edges are no longer adjacent but spaced thus revealing a void or gap between the first and second circumferential edges. This visual indicator evidences that the closure assembly (and container) has been opened and reclosed.

The first circumferential edge of the first outer sleeve may provide a circumferential first beaded portion on the first outer sleeve, and in a same manner the second circumferential edge of the second outer sleeve may provide a circumferential second beaded portion on the second outer sleeve.

The first and second outer sleeves may comprise any suitable material, and preferably the material comprises a metal, or metallic based material.

Preferably the metal or metallic based material substantially comprises aluminium or an alloy thereof, and particularly rolled aluminium.

Advantageously, aluminium provides a good medium for application of printing dyes, inks, paints or the like such that messages, logos, images, names, and other information may be carried by the first and second outer sleeves. A message may for example, comprise arrows indicating a direction of rotation for opening of the closure assembly.

The container closure member may be a cap which desirably includes a threaded portion which allows a rotational movement (normally anti-clockwise) of the cap during a container opening operation.

The closure assembly may include a non-refillable device providing a pouring outlet device adapted to be secured to the mouth of a container for liquid. The container closure member may be a cap adapted to close an outlet of the pouring outlet device, and the first outer sleeve may be adapted to receive at least part of the pouring outlet device. The outlet may be substantially annular and the cap may carry on an inner facing end an annular seal removably receivable within the annular outlet.

Preferably the second outer sleeve member is adapted to receive at least part of the cap.

The cap may be generally received in a tight interference fit to the second outer sleeve, but may be optionally rotatable with respect to the second outer sleeve upon application of sufficient force.

Desirably the pouring outlet device is made in one piece with the sleeve, e.g. by injection moulding.

Preferably the non-refillable device further comprises a valve seat body which is at least partially receivable within at least part of the neck portion of the container, and wherein the valve seat body is at least partially surrounded by the sleeve.

Preferably at least one moveable valve member is provided within the valve seat body.

Preferably there are provided means for retaining the first outer sleeve in longitudinal relation to the sleeve, e.g. an end of the first outer sleeve at least partially formed over an end of the sleeve.

Preferably the first and second circumferential edges of the first and second sleeves are before an initial opening of the closure assembly located within the circumferential groove provided on the cap, and are substantially adjacent. This positioning ensures that when the container is initially opened by relative twisting of the cap and sleeve, the second circumferential edge of the second outer sleeve remains within the groove provided on the cap, and the first circumferential edge of the first outer sleeve progressively resiliently may be caused to move circumferentially outward and out of the groove provided on the cap as the cap is removed away from the pouring outlet device and the first portion. Alternatively or additionally the circumferential lip portion may progressively be caused to move circumferentially inward. On removing the contact between the cap and the first circumferential edge of the first outer sleeve, the first circumferential edge retracts to a substantially reduce circumference, (e.g. its original circumference), such that the resulting circumference is less than that of a cap portion which is located below the groove. This cap portion is preferably provided as the circumferential lip on the cap.

When the cap is re-applied to the pouring outlet device, a stop position is reached when the circumferential lip portion of the cap rests, sits or abuts upon the first circumferential edge of the first outer sleeve, thus preventing the cap being returned to its original unopened starting position. A longitudinal gap or void therefore remains between the first and second outer sleeves thus exposing a circumferential part of the cap, which includes at least part of the circumferential lip which was originally encased or enclosed within the first circumferential edge and an original cap seating surface of the pouring device.

Advantageously the exposed circumferential part of the cap may be distinctly coloured and/or printed with information, promotional messages or the like.

The fixing means may comprise first means for fixing the sleeve on the container so as to restrain rotational movement of the sleeve with respect to the neck portion of the container.

The fixing means may also comprise second means for fixing the sleeve on the container so as to restrict longitudinal movement of the sleeve with respect to the mouth of the container.

Preferably the second means for fixing the sleeve are in the form of at least one projecting means projecting inwardly of said sleeve, said at least one projecting means being moveable radially of the sleeve in a stiffly resilient manner and being engagable with an outer lip portion of said container.

Preferably the first outer sleeve fits with the sleeve by means of an interference fit between an outer surface of the sleeve and an inner surface of the first outer sleeve.

Preferably the cap has thereon a threaded portion which engages with a corresponding threaded portion on the pouring outlet.

It is desired that the first and second outer sleeves are aesthetically pleasing, and as such, it is preferred that the first and second outer sleeves comprise metal foil.

It is preferred that there are provided means for assembling the sleeve and valve seat body together prior to application to the container.

Preferably the projecting means are provided on an inner wall of the sleeve to resiliently engage the neck portion of the container.

Preferably the sleeve contains one or more circumferential apertures around the sleeve, which are, defined between axially extending portions of the sleeve. The/each projecting means may be provided adjacent to an edge of one of the apertures.

It is preferred that each projecting means is positioned on a lower circumferential edge of one of the apertures.

Typically the pouring outlet device comprises a circumferentially extending pouring lip.

The sleeve may further be provided with a tubular body position inwardly and preferably concentrically of the pouring outlet device and wherein the tubular body is attached to an inner surface of the sleeve via a plurality of webs.

Further, a bore of the tubular body may be closed, and in particular, an outer facing wall which closes the tubular body is preferred.

Alternatively the tubular body may be solid or a wall may be positioned at any convenient axial location along the tubular body.

Preferably the closed wall of said tubular body is positioned to be substantially flush with the circumferential pouring lip.

Conveniently said tubular body is provided with a circumferentially extending brim which is positioned on the lower outer edge of said tubular body. Conveniently webs connect an inner surface of the sleeve to the brim and to the tubular body.

Conveniently each web is configured to provide a bracket upon which the brim fixedly sits.

The sleeve is further conveniently provided with a plurality of ribs or ridges formed on an inner surface thereof, preferably arranged circumferentially around the sleeve and having their long axes arranged substantially axially to said sleeve.

These ribs or ridges, in use, may co-act with raised pips, ridges or the like, on an outer surface of the container (e.g. a "glass finish" of the bottle) to seek to prevent undesired rotational movement of the sleeve.

The valve seat body may comprise a tubular portion, a free end portion of which provides a valve seat adapted to be contacted in a sealing manner by a valve member captive in said tubular portion.

The valve seat is preferably a circumferentially extending flange, which extends radially inwardly of the tubular portion. In one embodiment such a valve seat is positioned at one end of the tubular portion, and that end of the tubular portion is closed except for a circular aperture.

It will be understood that the tubular portion is adapted to be received substantially within the mouth portion of the container.

The tubular portion may further comprise at least one engagement means on an outer surface thereof to engage an inner surface of the container in an interference fashion.

The engagement means are preferably radially extending circumferential ribs.

At or near to an end of the tubular portion distant from the valve seat is provided a substantially concentric further tubular body of greater diameter than the tubular portion, and an inner surface of the further tubular body is connected to an outer surface of the tubular portion by one or more further webs.

It is preferred that a first end of the further tubular body is connected to an outer surface of the tubular portion by an annular flanger.

Thus, in one embodiment of the present invention, such construction provides a circumferential trough defined between the outer surface of the tubular portion and the inner surface of the further tubular body with the flange forming a trough floor. The trough is divided into smaller arc-shaped troughs by the further webs.

Such a trough helps prevent insertion of objects into the container through the closure assembly.

Preferably a second end of the further tubular body is arranged substantially flush with an end of the tubular portion distant from the valve seat.

In use the tubular portion forms an inner sleeve of the assembled closure assembly.

Advantageously, an outer surface of the further tubular body interference interacts with an inner surface of the sleeve.

Conveniently, a radially extending circumferential rim is located on an outer edge of an end of the further tubular body, which, in an assembled closure assembly is seated against a lower surface of a radially extending circumferential rim provided on an inner surface of the sleeve.

According to a second aspect of the present invention, there is provided a container including a closure assembly according to the first aspect of the present invention.

The container is preferably a container for liquid.

The container may be a bottle, e.g. a glass bottle, and may be adapted for containment of liquid, such as alcoholic drinks or beverages, e.g. spirits such as vodka, whisky, brandy, gin or the like.

According to a third aspect of the present invention there is provided a combination of a container and a closure assembly according to the first aspect of the present invention.

According to a fourth aspect of the present invention there is provided an alcoholic drinks product comprising an alcoholic substance packaged in the combination according to the third aspect of the present invention.

According to a fifth aspect of the present invention there is provided a method of manufacturing a closure assembly comprising the steps of:

(a) providing an outer sleeve member;

(b) providing a pouring outlet device and a sleeve adapted to be secured to a mouth and neck portion of a container for liquid and a container closure member releasably securable to the pouring outlet device and/or sleeve;

(c) disposing the pouring outlet device, sleeve and container closure member at least partly within the outer sleeve member;

(d) forming the outer sleeve member into a first outer sleeve and a separate second outer sleeve.

This method is particularly advantageous in mass production.

Preferably step (d) is carried out using a first cutting tool such as a blade of a machine tool.

Preferably step (d) comprises:

forming a cut around a portion of the outer sleeve member so as to form adjacent first and second circumferential edges on the first and second outer sleeves.

Advantageously, the first and second edges are formed in a groove carried on the container closure member (prior to initial opening).

Advantageously the first and second circumferential edges are of reduced diameter compared to at least adjacent portions of the first or second outer sleeve, respectively.

Preferably after step (c) the method also comprises the step of:

(e) forming an end of the first outer sleeve over an end of the sleeve so as to retain the first outer sleeve and the sleeve in longitudinal relation.

Preferably step (e) is carried out using a second cutting tool such as a further blade of a machine tool.

Steps (d) and (e) may be undertaken substantially simultaneously.

The closure assembly so formed may comprise a unitary assembly for snap-on application to a mouth and neck portion of a container.

According to a sixth aspect of the present invention there is provided a method of bottling comprising:

(a) providing a closure assembly manufactured according to the fifth aspect of the invention;

(b) providing a bottle;

(c) filling the bottle with a liquid;

(d) closing the bottle by applying the closure assembly to a mouth and neck of the bottle.

BRIEF DESCRIPTION OF DRAWINGS

An embodiment of the present invention will now be described by way of example only, with reference to the accompanying drawings, which are:

FIG. 1 a cross-sectional view a closure assembly according to an embodiment of the present invention during an initial step of manufacture;

DETAILED DESCRIPTION OF DRAWINGS

Figure 3:
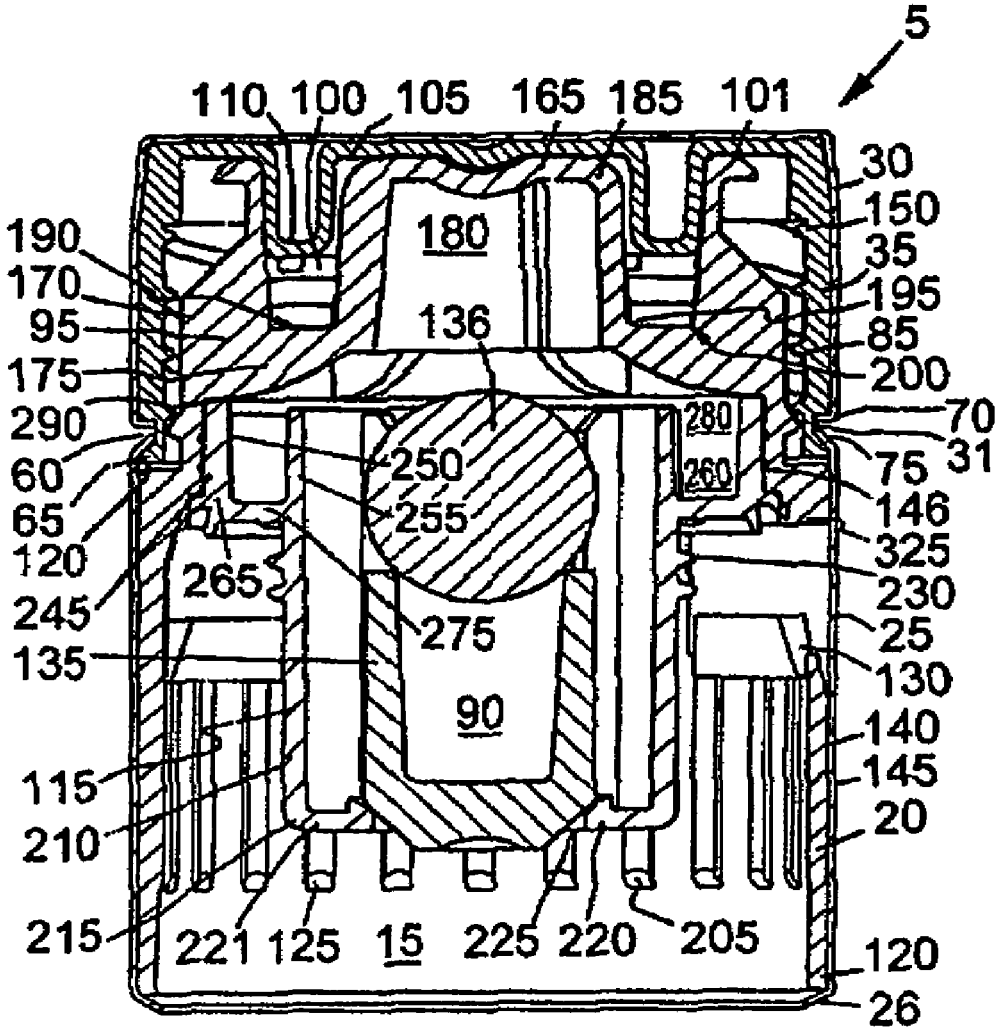
FIG. 3 a cross-sectional view of the closure assembly of FIG. 1 after manufacture and prior, to initial opening.
Figure 4:
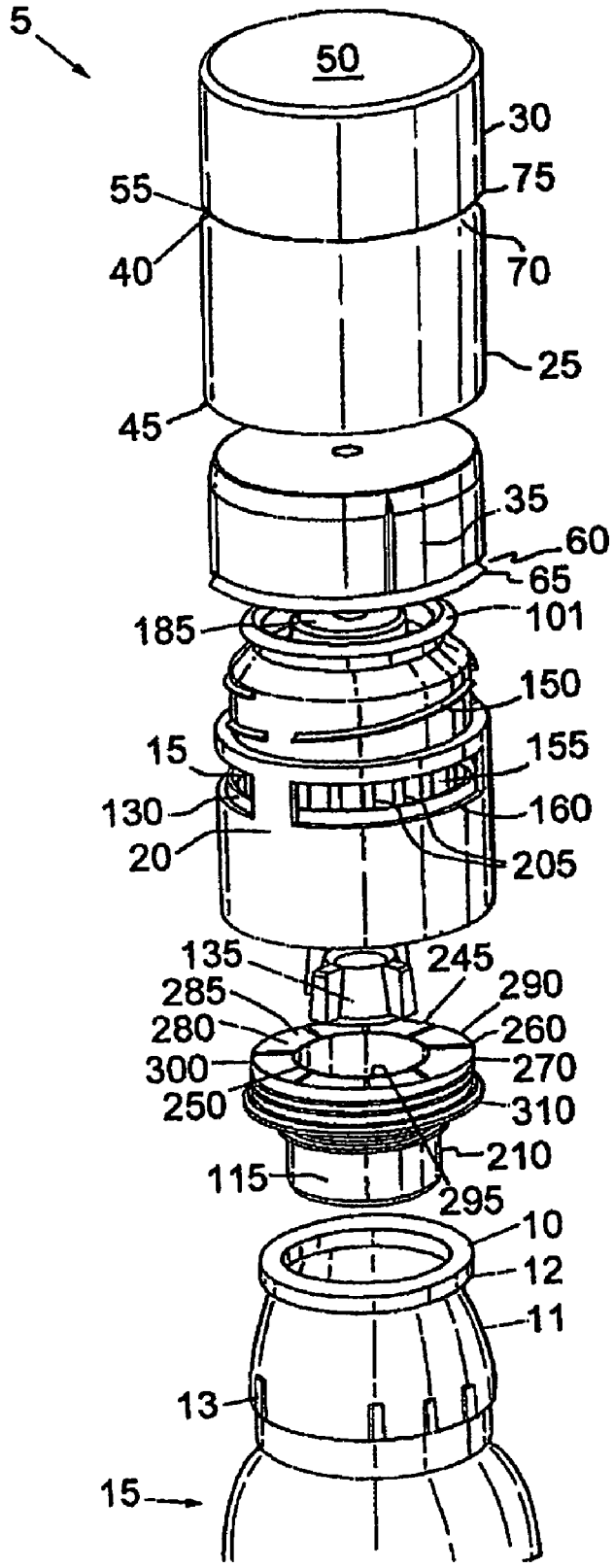
FIG. 4 an exploded perspective view of the closure assembly of FIG. 3 in combination with a bottle having a neck and mouth.
Figure 5:
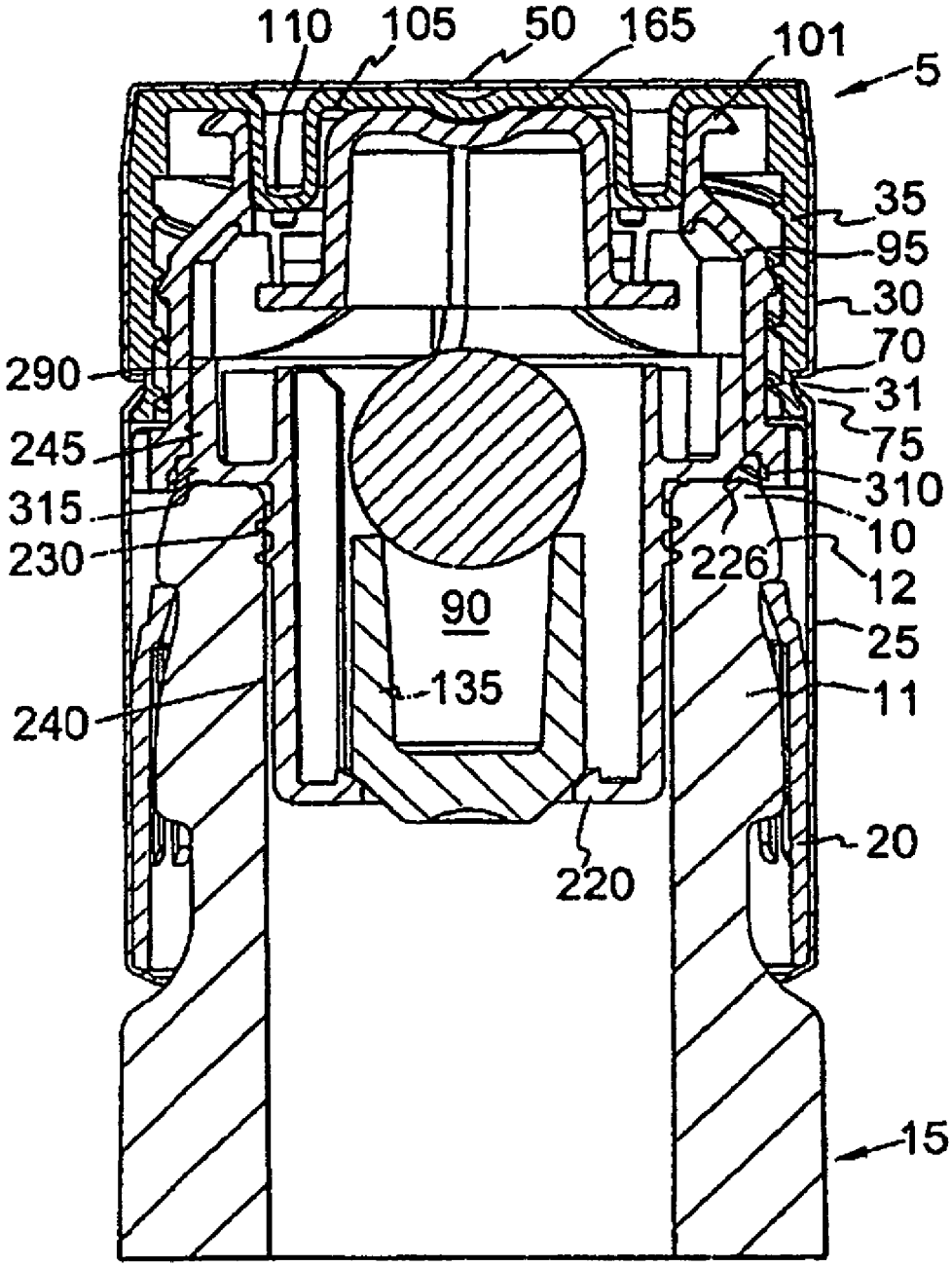
FIG. 5 a cross-sectional view of the closure assembly of FIG. 3 applied to the bottle of FIG. 4 prior to initial opening.

Referring initially to FIGS. 3, 4 and 5, there is shown a closure assembly (or tamper-evident device), generally designated 5, according to an embodiment of the present invention. The closure assembly 5 is adapted to be applied to a mouth and neck portion 10,11 of a container or bottle 15 for liquid. The closure assembly 5 comprises a sleeve 20 adapted to lie substantially concentrically with respect to the mouth 10 and provided with means for fixing the sleeve 20 on the container 15. The closure assembly 5 further comprises a first outer sleeve 25 being a substantially tight interference fit with the sleeve 20 but rotatable with respect thereto upon application of sufficient rotational force. The closure assembly 5 also comprises a second outer sleeve 30 separate from the first outer sleeve 25 and associated with a container closure member 35. Between the initially unopened first and second outer sleeve 25,30 there is provided a circumferentially extending cut line 31 formed as will hereinafter be described. The cut line 31 extends 360° around the closure assembly 5 and separates the first and second outer sleeve 25,30. The cut line 31 may be unperceivable or at least almost unperceivable by the naked eye. There are also provided means for spacing apart initially adjacent portions of the first and second outer sleeves 25,30 upon reclosure of the closure assembly 5 after an initial opening of the container 15 as will hereinafter be described in greater detail.

The Applicant has named the closure assembly 5 of the present invention the "ALUSNAP" (Trade Mark) non-refillable closure assembly or tamper-evident device.

The first outer sleeve 25 has open first and second ends 40,45, and the second outer sleeve has a first closed end 50 and a second open end 55.

The container closure member 35 includes a circumferential groove 60, and further provides a circumferential lip portion 65 located below and adjacent to the circumferential groove 60.

The initially adjacent portions comprise initially adjacent respective circumferential edges 70,75 of the first and second outer sleeves 25,30. The first and second circumferential edges 70,75 are prior to initial opening located in the circumferential groove 60 and are substantially adjacent one another.

During an initial container opening operation, the first circumferential edge 70 expands or rides over the circumferential lip portion 65 and then recoils or retracts to substantially its original circumferential position so as to become positioned radially behind the circumferential lip portion 65. Alternatively or additionally during an initial container opening operation, the circumferential lip portion 65 contracts or rides under the first circumferential edge 70 and then recoils or expands to substantially its original circumferential position so as to become positioned radially ahead of the first circumferential edge 70. This action or these actions position the circumferential lip portion 65 longitudinally between the first and second circumferential edges 70,75 in an obstructive manner such that when the container 15 is reclosed by reapplying the closure member 35, the first and second outer sleeves 25,30 are spaced apart by the circumferential lip portion 65 located therebetween.

By this arrangement after reclosure the first and second circumferential edges 70,75 are no longer adjacent but spaced, thus revealing a void or gap substantially comprising groove 60 and lip portion 65 between the first and second circumferential edges 70,75. This visual indicator evidences that the closure assembly 5 (and container 15) has been opened and reclosed.

The first circumferential edge 70 of the first outer sleeve 25 may in a modification provide a first circumferential beaded portion on the first outer sleeve 25 adjacent first circumferential edge 70, and in a same manner the second circumferential edge 75 of the second outer sleeve 30 may provide a second circumferential beaded portion on the second outer sleeve 30 adjacent second circumferential edge 75.

The first and second sleeves 25,30 are made from any suitable material, e.g. a metal or metallic based material. In this embodiment the metal substantially comprises aluminium or an alloy thereof, e.g. rolled aluminium. Aluminium provides a good medium for application of printing dyes, inks, paints or the like such that messages, logos, images, names, and other information may be carried by the first and second outer sleeves 25,30.

The container closure member 35 is in the form of a cap which includes an internally threaded portion 85 which allows a rotational movement (normally anti-clockwise) of the cap 35 during a container opening operation, and a contra-rotational movement (normally clockwise) of the cap 35 during a container closing operation.

The closure assembly 5 include a non-refillable device 90 providing a pouring outlet device 95 adapted to be secured to the mouth 10 of the container 15 for liquid. The container closure member 35 is adapted to close an outlet 100 of the pouring outlet device 95, the first outer sleeve 25 optionally being located to receive at least part of the pouring outlet device 95. The outlet 100 is substantially annular and the cap 35 carries on an inner facing end 105 an annular seal 110 removably receivable within the annular outlet 100. The annular outlet 100 defines a circumferential pouring lip 101.

The second outer sleeve 30 is adapted to receive the cap 35 The cap 35 is generally received in a tight interference fit to the second outer sleeve 30, but may be rotatable with respect to the second outer sleeve 35 upon application of sufficient force. For example, upon reclosure of the closure assembly 5, when circumferential lip portion 65 abuts first circumferential edge 70 further reclosure movement (e.g. clockwise turning of second outer sleeve 25) causes closure member 35 to remain stationery and outer sleeve 25 to rotate relative thereto. Further, the second circumferential edge 75 maintains the second outer sleeve 30 in longitudinal relation with the closure member 35.

The pouring outlet device 95 is made in one piece with the sleeve 20, e.g. by injection moulding.

The non-refillable device 90 further comprises a valve seat body 115 which is at least partially receivable within at least part of the neck portion 11 of the container 15, the valve seat body 115 being at least partially surrounded by the sleeve 20. First and second moveable valve members 135, 136 are provided within the valve seat body 115. The first valve member 135 comprises a spherical body while the second valve member 136 comprises a finned tubular body having a downwardly directed closed frustonical lower end and an open upper end which may be received by the first valve member 135.

A non-return valve is formed from the valve seat body 115 and valve members 135,136 which is closed in a normally upright position of the bottle 15, and which while allowing liquids to flow from the bottle 15 in a pouring operation, restricts in-flow of liquid into the bottle 15 by rudimentary unauthorised filling operations or even more sophisticated methods which may involve attempted insertion of objects, tubes or the like into the bottle mouth 10.

There are provided means for retaining the first outer sleeve 25 in longitudinal relation to the sleeve 20, e.g. an end 26 of the first outer sleeve 25 formed (bent) over an end 120 of the sleeve 20.

The first and second circumferential edges 70,75 of the first and second outer sleeves 70,75 are, before an initial opening of the closure assembly 5, located within the circumferential groove 60 provided on the cap 35, and are substantially adjacent. This positioning ensures that when the container 15 is initially opened by relative twisting of the cap 35 and sleeve 20, the second circumferential edge 75 of the second outer sleeve 30 remains within the groove 60 provided on the cap 35, and the first circumferential edge 70 of the first outer sleeve 25 progressively resiliently may be caused to move circumferentially outward and out of the groove 60 provided on the cap 35 as the cap 35 is removed away from the pouring outlet device 95 and the first outer sleeve 25 portion. Alternatively or additionally as mentioned above, the circumferential lip portion 65 may progressively resiliently move circumferentially inward. On removing the contact between the cap 35 and the first circumferential edge 70 of the first outer sleeve 25, the first circumferential edge 70 retracts to a substantially reduced circumference (e.g. its original circumference), such that the resulting circumference is less than that of a cap portion which is located below the groove 60, e.g. circumferential lip portion 65.

When the cap 35 is re-applied to the pouring outlet device 95, a stop position is reached when the circumferential lip portion 65 of the cap 35 rests, sits or abuts upon the first circumferential edge 70 of the first outer sleeve 25, thus preventing the cap 35 being returned to its original starting (unopened) position. A longitudinal gap or void (not shown) therefore remains between the first and second outer sleeves 25,30 thus exposing a circumferential part of the cap 35, which includes at least part of the circumferential lip portion 65 which was originally encased or enclosed within the first outer sleeve 25. A further void (not shown) also exists between a lower edge of the cap 35 and an original cap 35 seating surface 120 of the pouring outlet device 95.

Advantageously the exposed circumferential part of the cap 35 may be distinctly coloured and/or printed with information, promotional messages or the like.

The fixing means comprise first means 125 for fixing the sleeve 20 on the container 15 so as to restrain rotational movement of the sleeve 20 with respect to the neck portion 11 of the container 15.

The fixing means also comprise second means 130 for fixing the sleeve 20 on the container 15 so as to restrict longitudinal movement of the sleeve 20 with respect to the mouth 10 of the container 15. The second means 130 for fixing the sleeve 20 are in the form of at least one projecting means 130 projecting inwardly of said sleeve 20, said at least one projecting means 130 being moveable radially of the sleeve 30 in a stiffly resilient manner and being engagable with an outer lip portion 12 of said container 15.

The first outer sleeve 25 fits with the sleeve 20 by means of an interference fit between an outer surface 140 of the sleeve 20 and an inner surface 145 of the first outer sleeve 25.

The cap 35 has therein threaded portion 85, which engages with a corresponding threaded portion 150 on the pouring outlet device 95.

It is desired that the first and second outer sleeves 25,30 are aesthetically pleasing, and as such, the first and second outer sleeves 25,30 comprise metal foil.

There are provided means 146 for assembling the sleeve 20 and valve seat body 115 together prior to application to the container 1.5, such as co-acting ribs and grooves carried by each.

The projecting means 130 are provided on an inner wall 15 of the sleeve 20 to resiliently engage the neck portion 11 and outer lip portion 12 of the container 15.

The sleeve 20 contains one or more circumferential apertures 115 around the sleeve 20, which are defined between axially extending portions of the sleeve 20. The/each projecting means 130 are provided adjacent to an edge of one of the apertures 115.

As can be seen in this embodiment each projecting means 130 is positioned on a lower circumferential edge 160 of one of the apertures 155.

The sleeve 20 further carries a tubular body 165 positioned inwardly and substantially concentrically of the pouring outlet device 95. The tubular body 165 is attached to an inner portion 170 of the sleeve 20 or pouring outlet device 95 via a plurality of webs 175. A bore 180 of the tubular body 165 is closed by an outer facing wall 185. In a modification the tubular body 1.65 may be solid or a wall may be positioned at any convenient axial location along the tubular body 165. The closed wall 185 of said tubular body 165 is positioned to be substantially flush with the circumferential pouring lip 101.

The tubular body 165 is provided with a circumferentially extending brim 190 which is positioned on the lower outer edge 195 of said tubular body 165. Conveniently the webs 175 connect an inner surface 200 of the sleeve 20 to the brim 190 and to the tubular body 165. Each web 175 is configured to provide a bracket upon which the brim 190 fixedly sits.

The sleeve 20 is further conveniently provided with a plurality of ribs (or ridges) 205 formed on an inner surface 210 thereof, in this embodiment arranged circumferentially around the sleeve 20 and having their long axes arranged substantially axially to said sleeve 20. These ribs 205, in use, form first means 125 for anti-rotation co-act with raised pips, ridges or the like 13, on an outer surface of the container 15 (comprising a so-called "glass finish" of the bottle) to seek to prevent undesired rotational movement of the sleeve 20.

Some minor rotational play in either a clockwise or anti-clockwise direction may occur until a stop position is found by a rib or ribs 205 acting against a ridge or ridges 13. However, continued application of force will cause the first outer sleeve 35 and/or the second outer sleeve 30 to rotate relative to the sleeve 20 and/or cap 35, respectively.

The valve seat body 115 comprise a tubular portion 210, a free end portion 215 of which provides a valve seat 220 adapted to be contacted in a sealing manner by first valve member 135 captive in the tubular portion 210.

The valve seat 220 comprises a circumferentially extending flange 221, which extends radially inwardly of the tubular portion 210. In this embodiment the valve seat 220 is positioned at one end of the tubular portion 210, and that end of the tubular portion 210 is closed except for a circular aperture 225.

The tubular portion 210 is adapted to be received substantially within the mouth 10 portion of the container 15. The tubular portion 210 further comprises at least one engagement means 230 on an outer surface 235 thereof to engage an inner surface 240 of the container 15 in an interference fashion. The engagement means 230 comprise radially extending circumferential ribs.

At or near to an end of the tubular portion 210 distant from the valve seat 220 is provided a substantially concentric further tubular body 245 of greater diameter than the tubular portion 210, and an inner surface 250 of the further tubular body 245 is connected to an outer surface 255 of the tubular portion 210 by one or more further webs 260.

Further, a first end 265 of the further tubular body 245 is connected to an outer surface 255 of the tubular portion 210 by an annular flange 275. Such construction provides a circumferential trough 280 defined between the outer surface 270 of the tubular portion 210 and the inner surface 250 of the further tubular body 275 with the flange 275 forming a trough floor. The trough 280 is divided into smaller arc-shaped troughs 285 by the further webs 260.

Such a trough 280 or troughs 285 help prevent insertion of objects into the container 15 through the closure assembly 5.

A second end 290 of the further tubular body 245 is arranged substantially flush with an end 295 of the tubular portion 210 distant from the valve seat 220.

In use, the tubular portion 210 forms an inner sleeve of the assembled closure assembly 5.

An outer surface 300 of the further tubular body 245 interference interacts with an inner surface 305 of the sleeve 20. Conveniently, a radially extending circumferential rim 310 is located on an outer edge 315 of an end of the further tubular body 245, which, in an assembled closure assembly 5 is seated against a lower surface of a radially extending circumferential rim 226 provided on an inner surface of the sleeve 20.

In the embodiment disclosed the container 5 is preferably a container for liquid. The container 5 is most likely a bottle, e.g. a glass bottle, suitable for containment of liquid, such as alcoholic drinks or beverages, e.g. spirits such as vodka, whisky, brandy, gin or the like.

Typically, the bottle 5 is made from glass or alternatively a plastics material, the first and second outer sleeves 25,30 from aluminium, the cap 35 from low density polyethylene, the sleeve 30 and pouring outlet 95 from a stiffly resilient plastics material such as polypropylene or polystyrene and which in this embodiment is a polystyrene obtainable under the trade name STYROLUX, the valve member 135 from crystal polystyrene and the valve seat body 115 from low density polyethylene.

Figure 2:
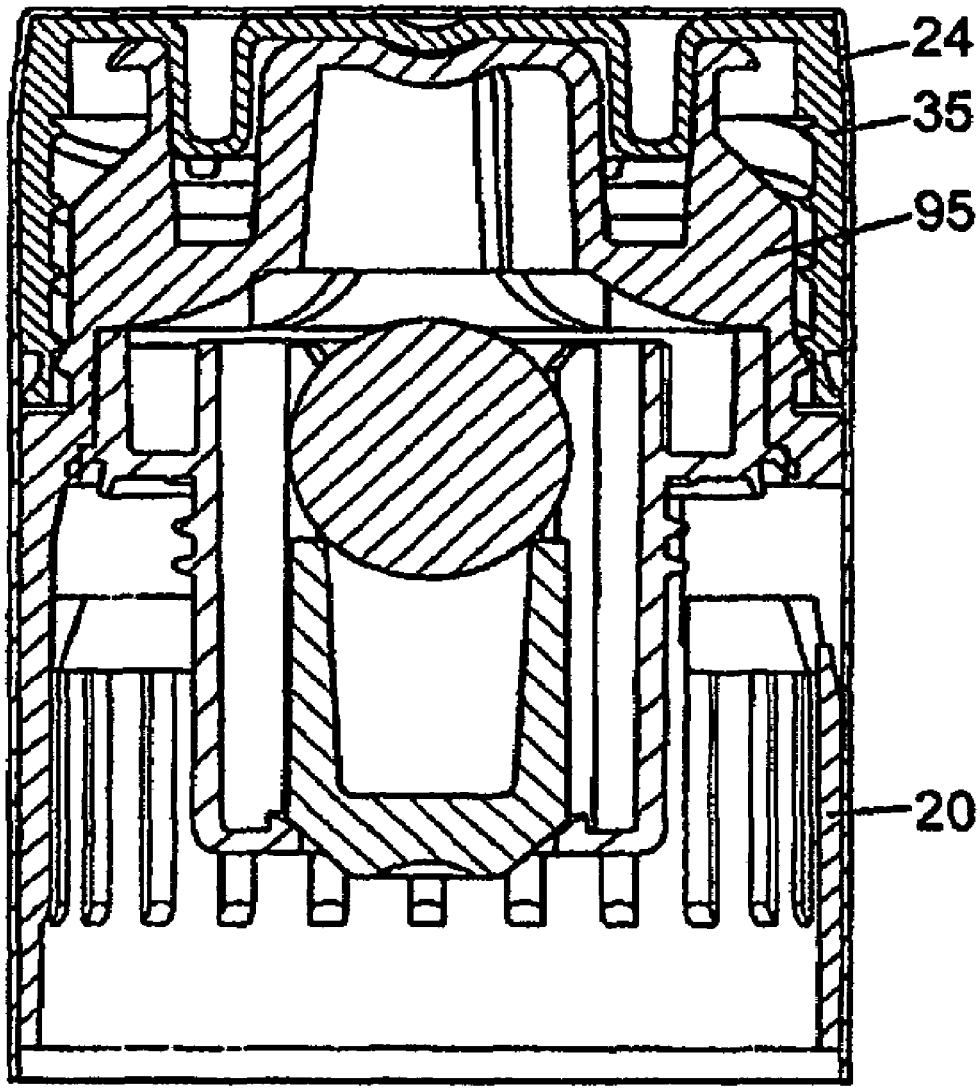
FIG. 2 a cross-sectional view of the closure assembly of FIG. 1 during an intermediate step of manufacture.

Referring now to FIGS. 1 to 3, there is illustrated a method of manufacturing a closure assembly 5 according to the present invention. The method comprises the steps of:

(a) providing an outer sleeve member 24 (FIG. 1);

(b) providing pouring outlet device 95 and sleeve 20 adapted to be secured to mouth and/or neck portion 10,11 of container 15 for liquid, and container closure member 35 releasably securable to the pouring outlet device 95 and/or sleeve 20 (FIG. 1);

(c) disposing the pouring outlet device 95, sleeve 20 and container closure member 35 at least partly within the outer sleeve member 24 (FIG. 2);

(d) forming the outer sleeve member 24 into first outer sleeve 25 and separate second outer sleeve 30 (FIG. 3).

This method is particularly advantageous in mass production. Step (d) is carried out using a first cutting tool such as a blade of a machine tool (not shown).

Step (d) comprises: forming a cut around a portion of the outer sleeve member 24 so as to form the adjacent, but separate, first and second circumferential edges 70,75 on the first and second outer sleeves 25,30. In this way the blade forms cut line 31 hereinbefore mentioned.

As can be seen from FIG. 3 the first and second circumferential edges are formed in circumferential groove 60 carried on the container closure member 35. Also as can be seen, the first and second circumferential edges 70,75 are of reduced diameter compared to at least adjacent portions of the first or second outer sleeves 25,30 respectively.

After step (c) the method also comprises the step of:

(e) forming end 26 of the first outer sleeve 25 over end 120 of the sleeve 20 so as to retain the first outer sleeve 25 and the sleeve 20 in longitudinal relation. Step (e) is carried out using a second cutting tool such as a further blade (not shown) of the machine tool. In this embodiment steps (d) and (e) are beneficially undertaken substantially simultaneously, e.g. for reasons of speed of manufacture.

The closure assembly 5 formed by this method comprises a unitary assembly for snap-on application to a mouth and neck portion 10,11 of a container 15.

A method of bottling according to the present invention comprises:

(a) providing closure assembly 5;

(b) providing bottle 15;

(c) filling the bottle 15 with a liquid;

(d) closing the bottle 15 by applying the closure assembly 5 to a mouth and neck portion 10,11 of the bottle 15.

It will be understood that the embodiment of the invention hereinbefore described is given by way of non-limiting example only, and that modifications may be mad e without departing from the scope of the present invention.

For example, the outer sleeve member may be applied to various different designs of pouring device adapted to be applied to a variety of containers including bottles.

In a modification, the second outer sleeve and/or the first outer sleeve may include knurred or castellated surfaces to assist in gripping in opening and reopening and/or closing and reclosing of the closure assembly.

It will further be appreciated that the present invention provides a particularly desirable one-piece snap-on fitment have functional advantages over the prior art as well as enhanced aesthetic appeal.

Finally, it will be appreciated that in the closure assembly of the present invention, prior to an initial opening the first and second circumferential edges of the first and second outer sleeves are substantially adjacent one another and may indeed even abut. However, they are not connected together, e.g. by any frangible break-line, frangible links or frangible and/or removable tear ring, but rather are distinct and separate one from the other.

The invention claimed is:

1. A closure assembly adapted to be applied to a mouth and neck portion of a container for liquid, the closure assembly comprising a sleeve adapted to lie substantially concentrically with respect to the mouth and provided with means for fixing the sleeve on the container, the closure assembly further comprising a first outer sleeve coaxially mounted over said sleeve and a second outer sleeve separate from the first outer sleeve and substantially tight fit with a container closure member, said first and second outer sleeves being axially aligned and having respectively initially adjacent portions, and means provided for axially spacing apart the initially adjacent portions of the first and second outer sleeves upon reclosure of the assembly after an initial opening of the container.

2. A closure assembly as claimed in claim 1, wherein the first outer sleeve has open first and second ends and the second outer sleeve has a first closed end and second open end.

3. A closure assembly according to claim 2, wherein said first outer sleeve comprises an end bent over an end of said sleeve.

4. A closure assembly as claimed in claim 1, wherein the container closure member includes a circumferential groove which further provides a circumferential lip portion located below and adjacent to the circumferential groove.

5. A closure assembly as claimed in claim 4, wherein first and second circumferential edges are, prior to initial opening, located in the circumferential groove substantially adjacent one another.

6. A closure assembly as claimed in claim 5, wherein during the initial container opening operation, the first circumferential edge expands or rides over the circumferential lip portion and then recoils or retracts to a substantially original circumferential position so as to become positioned circumferentially behind the circumferential lip portion.

7. A closure assembly as claimed in claim 5, wherein during an initial container opening operation, the circumferential lip portion contracts or rides under the first circumferential edge and then recoils or expands to a substantially original circumferential position so as to become positioned circumferentially ahead of the first circumferential edge.

8. A closure assembly as claimed in claim 6, wherein subsequent to an initial container opening operation, the circumferential lip is positioned longitudinally between the first and second circumferential edges in an obstructive manner such that when the container is reclosed by reapplying the closure member, the first and second outer sleeves are spaced apart at least by the circumferential lip portion located therebetween.

9. A closure assembly as claimed in claim 8, wherein after reclosure, the first and second circumferential edges are no longer adjacent but spaced so as to reveal a void or gap between the first and second circumferential edges so as to provide a visual indicator evidencing that the closure assembly has been opened and reclosed.

10. A closure assembly as claimed in claim 1, wherein the first and second outer sleeves comprise a metal or metallic based material.

11. A closure assembly as claimed in claim 1, wherein the container closure member is a cap which includes a threaded portion which allows a rotational movement of the cap during a container opening operation.

12. A closure assembly as claimed in claim 1, wherein the closure assembly includes a non-refillable device providing a pouring outlet device adapted to be secured to the mouth of a container for liquid.

13. A closure assembly as claimed in claim 12, wherein the container closure member comprises a cap adapted to close an outlet of the pouring outlet device, the first outer sleeve being adapted to receive at least part of the pouring outlet device, the outlet being substantially annular and the cap carrying on an inner facing end an annular seal removably receivable within the annular outlet.

14. A closure assembly as claimed in claim 13, wherein the second outer sleeve member is adapted to receive at least prt of the cap.

15. A closure assembly as claimed in claim 1, wherein between the initially unopened first and second outer sleeve (25, 30) there is provided a circumferentially extending cut line (31) extending 360° around the closure assembly and separating the first and second outer sleeve (25, 30).

16. A closure assembly as claimed in claim 1, wherein respective initially adjacent portions comprise initially adjacent respective circumferential edges (70, 75), and wherein there are provided means for spacing apart the initially adjacent portions of the first (25) and second (30) outer sleeves upon reclosure of the assembly after an initial opening of the container, and in that prior to initial opening the first and second circumferential edges (70, 75) of the first and second outer sleeves (25, 30) are substantially adjacent but are separate one from the other.

17. A closure assembly as claimed in claim 1, wherein the initially adjacent portions comprise adjacent respective circumferential edges of the first and second outer sleeves.

18. A closure assembly according to claim 17, wherein the first circumferential edge of the first outer sleeve is provided with a circumferential first beaded portion on the first outer sleeve and the second circumferential edge of the second outer sleeve is provided with a circumferential beaded portion on the second outer sleeve.

* * * * *